United States Patent [19]

Shibukawa

[11] Patent Number: 5,069,104

[45] Date of Patent: Dec. 3, 1991

[54] AUTOMATIC KEY-DEPRESSION INDICATION APPARATUS

[75] Inventor: Takeo Shibukawa, Hamamatsu, Japan

[73] Assignee: Yamaha Corporation, Hamamatsu, Japan

[21] Appl. No.: 466,876

[22] Filed: Jan. 17, 1990

[30] Foreign Application Priority Data

Jan. 19, 1989 [JP] Japan ..... 1-10336

[51] Int. Cl.[5] ..... G10H 7/00

[52] U.S. Cl. ..... 84/478; 84/477 R; 84/609

[58] Field of Search ..... 84/477 R, 478, 609, 84/470 R

[56] References Cited

U.S. PATENT DOCUMENTS

| | | | |
|---|---|---|---|
| 4,281,579 | 8/1981 | Bennett, Sr. | 84/478 |
| 4,363,299 | 12/1982 | Nakada et al. | 84/478 |
| 4,694,723 | 9/1987 | Shinohara et al. | 84/478 |

FOREIGN PATENT DOCUMENTS

| | | |
|---|---|---|
| 61-7629 | 3/1986 | Japan . |
| 62-10433 | 3/1987 | Japan . |

*Primary Examiner*—William M. Shoop, Jr.
*Assistant Examiner*—Helen Kim
*Attorney, Agent, or Firm*—Spensley Horn Jubas & Lubitz

[57] ABSTRACT

An automatic key-depression indication apparatus has an examination device which examines whether at least one of the musical note information corresponds to the key-depression information output from the key-depression control device, or not. When the decision is affirmative, it decides that at least one of the keys is correctly depressed which corresponds to a plurality of musical notes, the number of which is less than total number of the musical notes. A key-depression indication is then advanced, thereby enabling practice of a performance.

7 Claims, 7 Drawing Sheets

(STORAGE FORMAT OF KCREQ)

AUTOMATIC KEY-DEPRESSION INDICATION APPARATUS

BACKGROUND OF THE INVENTION

1. Field of the invention

The present invention relates to an automatic key-depression indication apparatus which is used in practicing a performance, and particularly relates to key-depression instruction arts for simultaneously depressing a plurality of keys composed of a chord, and the like.

2. Prior Art

It is known that a conventional automatic key-depression indication apparatus is disclosed in Japanese Patent Publication No 62-10433 The indication apparatus has a plurality of depression indication lamps corresponding to respective keys of a keyboard Each of the depressing indication lamps is turned on when scale data is read from a storage corresponding to each key so as to indicate the key which is depressed.

However, the conventional indication apparatus executes a key-depression indication for each musical note in accordance with a key state whether a key is correctly depressed or not. Therefore, in the case where several musical notes are simultaneously indicated by depressing keys, such as a chord performance, an octave performance, and the like, these indicated keys must be depressed correctly, otherwise the key-depression indication stops to advance the performance, so that the practice of the performance is not carried out smoothly.

SUMMARY OF THE INVENTION

It is accordingly an object of the present invention to provide an automatic key-depression indication apparatus capable of practicing performance smoothly, even though a musical piece which includes a plurality of musical notes is played by simultaneously depressing the keys.

In an aspect of the present invention, there is provided an automatic key-depression indication apparatus comprising: (a) a keyboard having a plurality of keys; (b) a plurality of key-depression indication elements corresponding to each of the keys; (c) key-depression control device for detecting the key which is depressed to generate key-depression information corresponding to the keys; (d) storage device for storing musical note information representing each of serial musical notes, the serial musical notes including plural musical notes corresponding to plural keys which should be simultaneously depressed; (e) key-depression indication control device for indicating the key which should be depressed, by actuating the key-depression indication elements corresponding to the musical note information from the storage device; (f) examination device for examining whether selected musical note information which is corresponding to at least one of the plural musical notes, corresponds to the key-depression information output from the key-depression control device or not, the at least one of the plural musical notes being less than total number of the plural musical notes; and (g) advance control device connected to the key-depression indication control means and examination means for controlling and stopping reproduction of the musical note information for indication of the key based on the result of the examination means.

Accordingly, the examination device examines whether at least one of the musical note information corresponds to the key-depression information output from the key-depression control device, or not. If the decision is affirmative, it decides that at least one of the keys is correctly depressed, allowing the advance of the key-depression indication to smoothly practice a performance.

DESCRIPTION OF THE PREFERRED EMBODIMENTS

Hereinafter, embodiments of the present invention are described with reference to the drawings.

Figure 1:
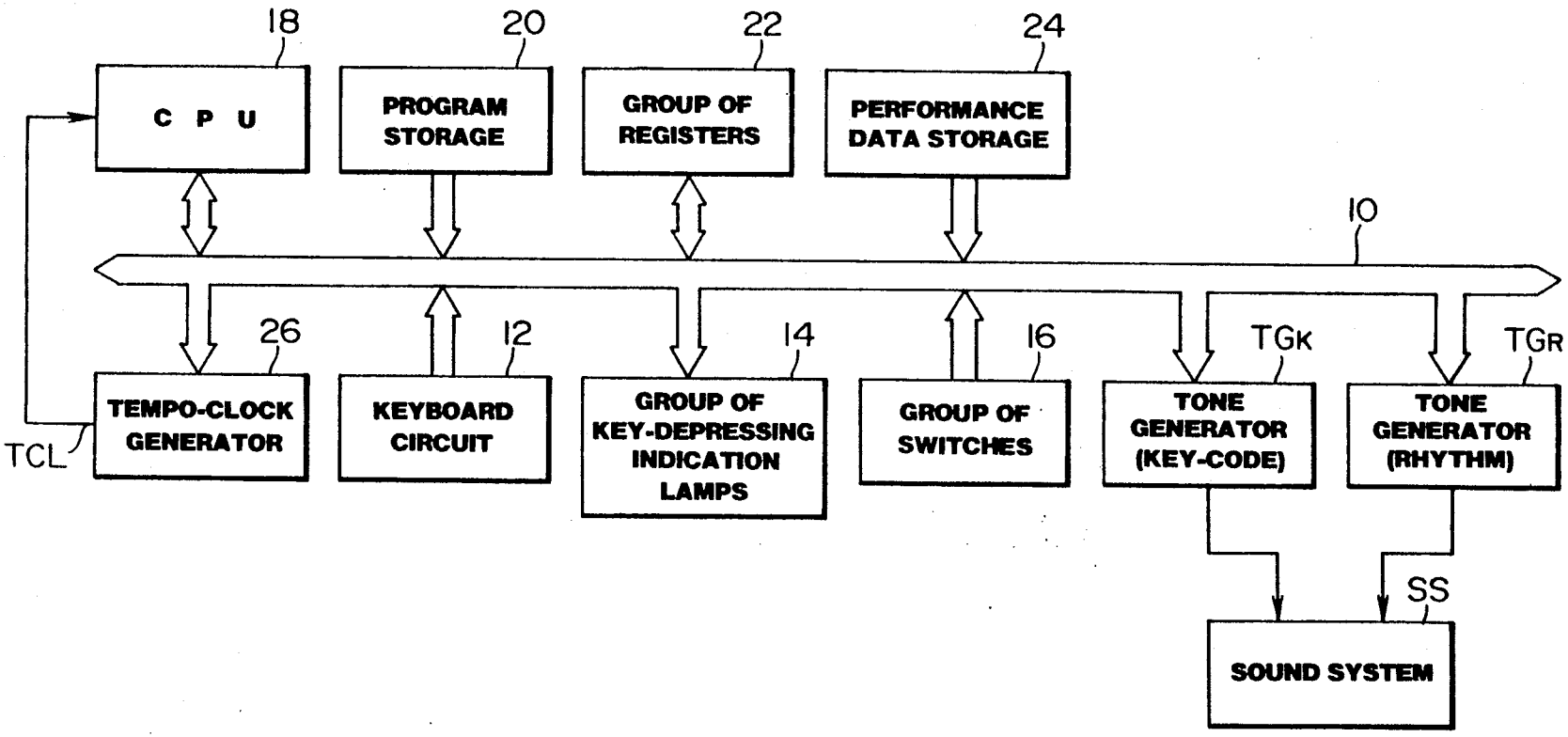
FIG. 1 is a block diagram showing an electronic musical instrument provided with an automatic key-depression indication apparatus of an embodiment of the present invention.

FIG. 1 shows an electronic musical instrument having an automatic key-depression indication apparatus. The electronic musical instrument has a normal mode, auto-play mode, and guide mode, each mode being controlled by a micro-computer. The normal mode generates a musical tone corresponding to keys of a keyboard played manually. The auto-play mode executes an automatic performance, such as a melody and the like, based on performance data stored in a storage. This mode can also execute an automatic rhythm performance. The guide mode executes a key-depression indication based on the performance data stored in the storage. In this mode, it is also possible to generate musical tones corresponding to the keys of the keyboard and to execute the automatic rhythm performance.

In FIG. 1, the diagram shows a data bus 10 connected to a keyboard circuit 12; a group of key-depression indication lamps 14; a group of switches 16, a CPU (central processing unit) 18; a program memory 20; a group of registers 22; a performance data memory 24; a tempo-clock generator 26; tone generators $TG_K$ and $TG_R$; and a sound system SS is connected to both tone generators $TG_K$ and $TG_R$.

Keyboard circuit 12 includes keys and detects key-operating information corresponding to each key.

The group of key-depression indication lamps 14 includes indication lamps or light-emitting diodes corresponding to each key.

The group of switches 16 includes rhythm selection switches, a tone color selection switch, a tone volume set switch, a tempo set switch, an auto-play mode indication switch (APSW), a guide mode indication switch (GDSW), and the like.

CPU 18 executes data processing for indicating key-depression, and for generating musical tones in accordance with a computer program stored in program storage 20. Details of the data processing of CPU 18 are described later with reference to FIGS. 6 to 9.

The group of registers 22 includes registers used for the data processing of CPU 18. Details of the operation of the registers is described later.

Performance data storage 24 stores performance data for indicating the key-depression indication and for automatically performing a melody, a chord, and the like; and rhythm pattern data for automatically performing a rhythm. The rhythm pattern data represents every type of rhythm which can be selected by the rhythm selection switch.

Figure 2:
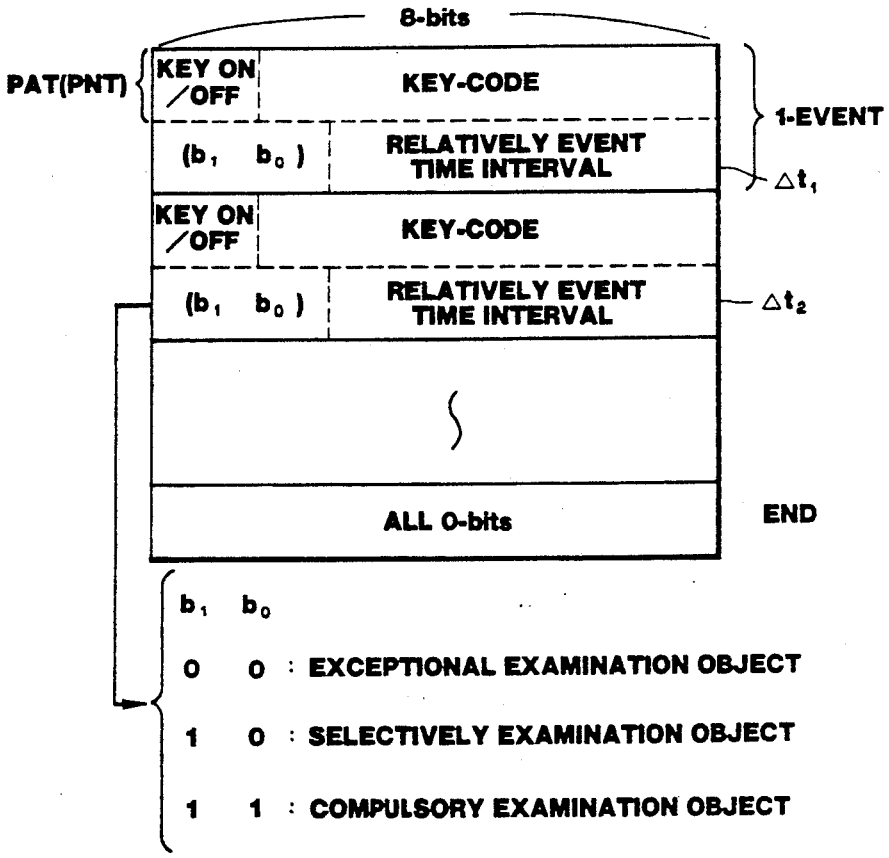
FIG. 2 is a diagram showing a storage format of performance data.

An example of performance data format is shown in FIG. 2, in which 2-bytes of data are stored for every single key-event, such as a key-on or key-off event, in the order of succession of the key-events. In the first byte of data of the 2-bytes data (key-event data), MSB (most significant bit) represents a key-on or key-off event depending on whether MSB is "1" or "0", and also, the remaining 7-bits represent a key-code. For example a $C_3$ tone is represented by "48" and predetermined in every tone pitch. In the second byte, each of the first 2-bits $b_0$ and $b_1$ represents an examination flag, and each of the remaining 6-bits represents a relative event time interval.

Figure 3:
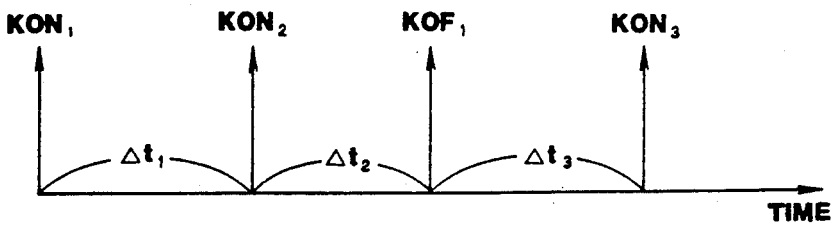
FIG. 3 is a time chart showing a time difference between key-events.

The relative event time interval is a time interval between key-events. For example as shown in FIG. 3, this can be a time interval $\Delta t_1$ between key-on events $KON_1$ and $KON_2$; a time interval $\Delta t_2$ between key-on event $KON_2$ and key-off event $KOF_1$; and a time interval $\Delta t_3$ between key-off event $KOF_1$ and key-on event $KON_3$. That is, when plural key-events are present at the same time such as with a chord, data for the plural key-events is, in turn, arranged in the plural storage areas of the plural key-events, and the relative event time interval becomes "0" for all data except for the most recently stored data. During operation in the guide mode, the key-off event is neglected. Therefore, when a key-on event $KON_2$ is terminated, the relative event time interval is represented by a summation such as $\Delta t_2+\Delta t_3$, and then the key-on event $KON_3$ is executed.

In the arrangement of performance data, assuming that a storage area for 1-byte of data represents PAT, the storage area PAT is indicated by an address based on an address pointer PNT. In this case, data stored in storage area PAT which is indicated by address pointer PNT is represented b PAT(PNT) for further descriptions. End data END is arranged in the last-byte of the performance data so that each of the 8-bits is "0".

Figure 4:
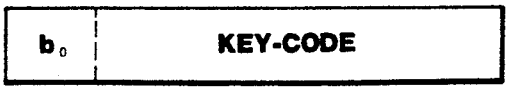
FIG. 4 is a diagram showing a storage format of register KCREQ.

Each of the examination flags $b_0$ and $b_1$ represents the following states; $b_0=0$ and $b_1=0$ represent an exceptional examination object, that is, the examination is not required whether the key is correctly depressed or not; $b_0=0$ and $b_1$ represent a selectively examination object, that is, the examination is selectively required whether the key is correctly depressed or not; and $b_0=1$ and $b_1=1$ represent a compulsory examination object, that is, the examination is compulsory required whether the key is correctly depressed or not. The selectively examination object means that key-depression indication can proceed if one of the plurality of keys is correctly depressed when each of the keys is simultaneously depressed at the time of tone generation in correspondence with the musical notes. The compulsory examination object means that key-depression indication can proceed if at least one of the keys among the plurality of keys is correctly depressed. When the key is correctly depressed, data being a combination of a key-code and the bit of the examination flag $b_0$ is stored in key-code register KCREQ used for an examination as shown in FIG. 4. However, this is only the case when the state is $b_1=1$, data of which is required for the examination. On the other hand, data being a combination the key-code and the examination flag $b_1=0$, and which is not required for the examination is not stored in the key-code register KCREQ.

Figure 5A:
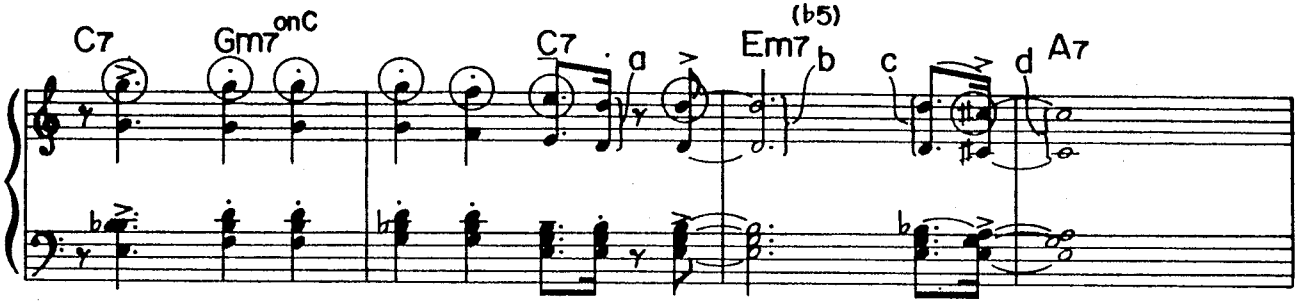
FIGS. 5(A) and 5(B) are musical scales showing examples of examination objects.
Figure 5B:
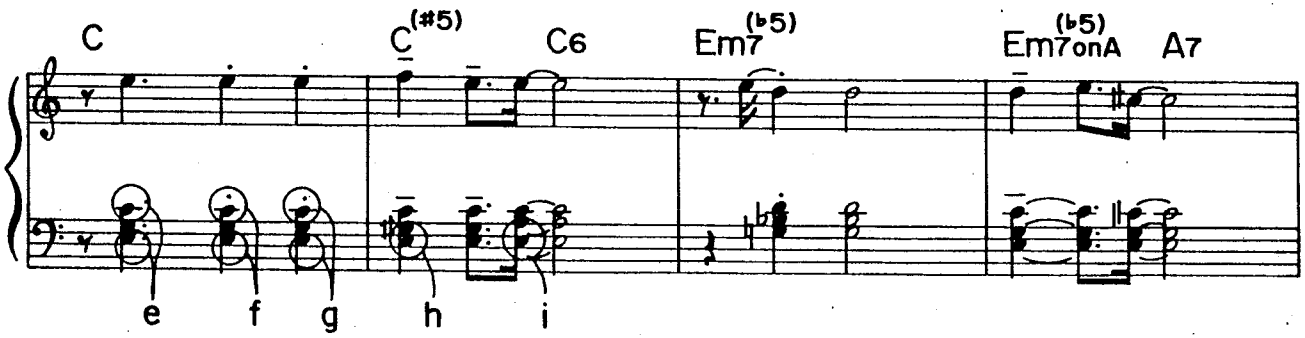

FIGS. 5(A) and 5(B) show an example wherein it is required examination whether a key is correctly depressed or not. In FIG. 5(A), the music score having a G clef, and the musical notes enclosed with a circle are the compulsory examination object which is required for a examination whether the keys are correctly depressed or not. That is, the keys of the musical notes enclosed with the circles should be correctly depressed. While musical notes not enclosed by a circle but which should be simultaneously depressed are the exceptional examination object. In such a case, a thirty-second note and a sixteenth note shown by "a" can be the exceptional examination object, and also, a musical note which is the same tone pitch as previous one can be the exceptional examination object as shown by "b", "c", and "d".

In FIG. 5(B), a music score having a bass clef, each of the two musical notes enclosed with individual circles, as shown by "e", "f", and "g" is the selectively examination object. The key corresponding to one of two musical notes enclosed by a circle can be therefore examined to determine whether the key is correctly depressed or not, and the remaining musical note not enclosed by a circle but which should be simultaneously depressed with the others is the exceptional examination object. Each of the two musical notes enclosed by a circle shown by "h" and "i" is the compulsory examination object. That is, the two musical notes must be examined to determine whether the keys are correctly depressed or not. A musical note without an enclosing circle but which should be simultaneously depressed with the other is the exceptional examination object. In such a case, each of the keys which is simultaneously depressed is correctly depressed as in the conventional manner, and this is also acceptable in the present invention. In this case is examined by a state so that the examination flags are indicated by $b_0=b_1=1$.

Referring back to FIG. 1, tempo-clock generator 26 generates a tempo-clock signal TCL having a frequency corresponding to a tempo which has been set by a tempo-setting switch. The tempo-clock signal TCL is supplied to CPU 18 as an interruption command.

Tone generator $TG_K$ has eight musical tone generation channels operated in correspondence with key-codes to generate a musical tone signal having a tone pitch which corresponds to the key-code supplied from each of the musical tone generation channels.

Tone generator $TG_R$ is used for generating a rhythm tone and has six percussion instrument ton channels corresponding to, for example, a bass drum, a snare drum, a cymbals, and the like.

Each of the musical and rhythm tone signals from tone generator $TG_K$ and tone generator $TG_R$ respectively is supplied to a sound system, such as an output amplifier, speakers, and the like, to convert the tone signals into a sound.

The group of registers 22 for use in execution of the present invention are described as follows:

(1) Auto-play mode flag AP

The flag is of a 1-bit register, the content of which is inverted at every On-state of the auto-play mode indication switch. When the auto-play mode flag AP becomes "1", operation is according to the auto-play mode or the guide mode. When it becomes "0", the operation is according to the normal mode. In other words, only when the auto-play mode flag AP is "1", the guide mode can be indicated.

(2) Tempo-clock counter CLK

The counter is for counting the number of tempo-clock signals TCL. The counter CLK indicates a value between "0" and "31" for a bar of music score in case of four-four time, and when the value becomes "32", the counter is reset to "0". The counter CLK is used for reading rhythm pattern data from the storage.

(3) Relatively event time interval counter CNT

The counter is for counting the number of "down" of the tempo-clock signal TCL after setting a relative event time interval When the value becomes "0", the next key-event data is read from the storage.

(4) Relatively event time interval buffer register DUR

The register is used in a performance, and used for adding several relative event time intervals when a key-off event is ignored and the process moves to a next key-on event during the reading a performance data. The number of bits of the buffer register DUR is the same as the number of bits of the counter CNT.

(5) Determination object register FLG

The register is used for searching data, and is an 8-bit register which stores a second byte (examination flags $b_0$ and $b_1$, relative event time interval) of the key-event data every time a first byte (key-on or key-off, and key-code) of the key-event data is read in. The process decides whether each of the depressed keys is a examination object or not, in accordance with MSB ($b_1$) of the register FLG.

(6) Guide mode flag GUIDE

The flag is of a 1-bit register which is inverted at every On-state of the guide mode indication switch. If the guide mode flag GUIDE is "1" when auto-play mode flag AP is "1", the event is a guide mode. If guide mode flag GUIDE is "0", the event is an auto-play mode.

(7) Key-code buffer registers $KCBUF_0$ to $KCBUF_N$

The registers are used for storing key-codes corresponding to the keys being depressed. For example, plural registers are used in correspondence with the number of tones which are simultaneously generated by tone generator $TG_K$ so that if tone generator $TG_K$ is set by 8-channels, the number of the key-code buffer registers is "8".

(8) Key-code registers $KCREQ_0$ to $KCREQ_3$

The registers are 8-bit registers, each being used for examining whether a key is correctly depressed or not. The register KCREQ shown in FIG. 4 is of one of four key-code registers $KCREQ_0$ to $KCREQ_3$. Each of the key-code registers $KCREQ_0$ to $KCREQ_3$ can store a combination of examination flag $b_0$ and a key-code data.

(9) Key-code read register KEV

The register is an 8-bit register for storing a first byte (key-on or key-off, and key-code) of key-event data.

(10) Address pointer PNT

The address pointer is used for indicating an address of storage area PAT in reading performance data.

(11) Relatively event time interval register TCNT

The register has the same number of bits as counter CNT has. Relatively event time interval data stored in buffer register DUR is set in counter CNT through the register TCNT.

Figure 6:
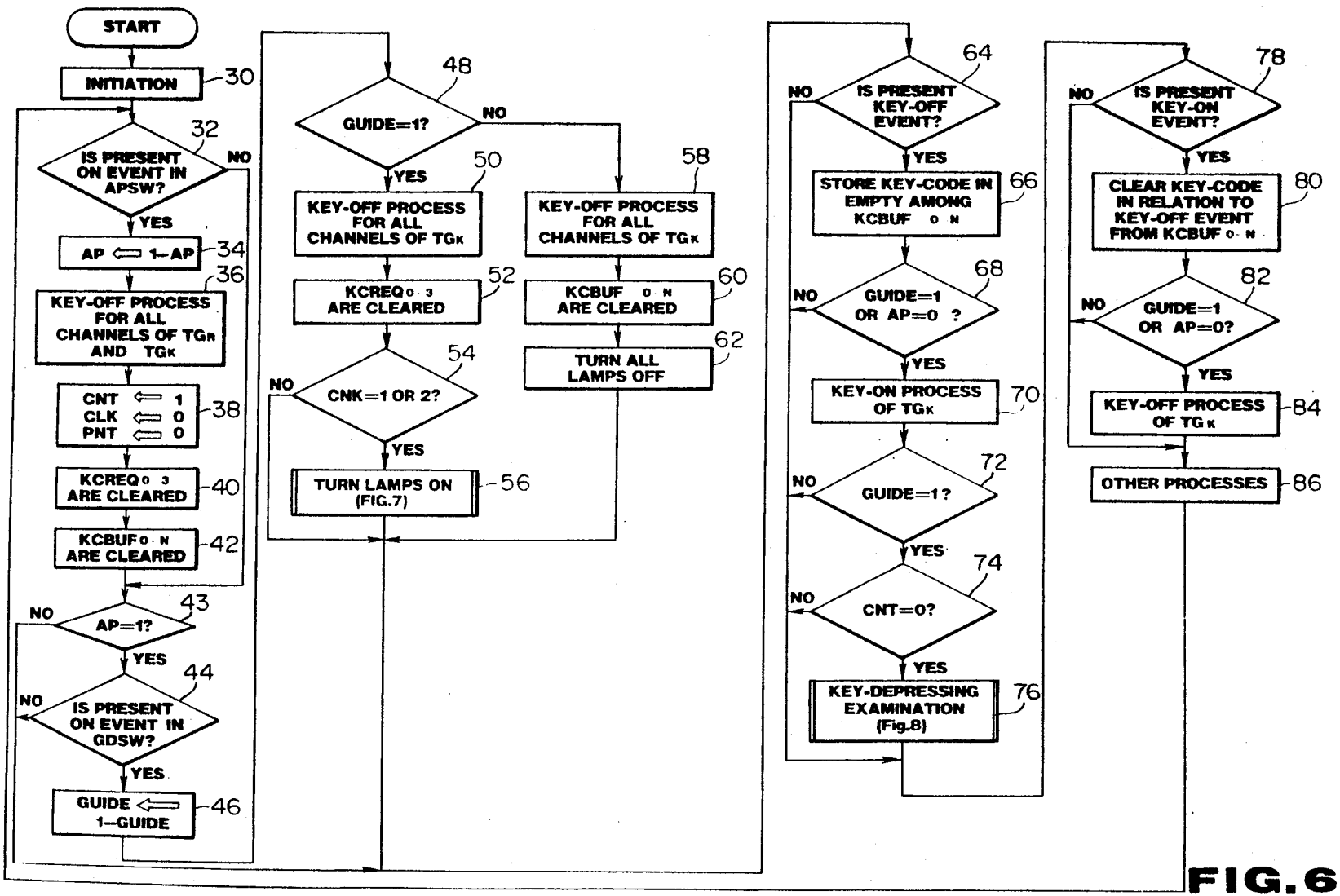
FIG. 6 is a flow chart showing a main routine.

A main routine is described in accordance with FIG. 6. The main routine process is started by turning a power switch on.

In step 30, an initiation routine is executed. For example, both auto-play mode flag AP and guide mode flag GUIDE are set to "0", "1" is set in the relative event time interval counter CNT (corresponding to the thirty-second note), and "0" is set in key-code buffer registers $KCBUF_0$ to $KCBUF_N$ and key-code registers $KCREQ_0$ to $KCREQ_3$.

In step 32, the process decides whether a key-on event is present in the auto-play mode indication switch APSW or not. If the decision is "yes", the process moves to step 34, otherwise it moves to step 43.

In step 34, the auto-play flag AP is inverted by subtracting the value of the auto-play flag AP from "1". The process then moves to step 36. That is, when the value of the auto-play flag AP is "0", the auto-play flag AP becomes "1". Conversely when the value of auto-play flag AP is "1", the auto-play flag AP becomes "0".

In step 36, the process of a key-off is executed so that all of the channels of tone generators $TG_K$ and $TG_R$ stop generating musical tones. The process then moves to step 38.

In step 38, "1" is set in the relative event time interval counter CNT, and "0" is set in both the tempo-clock counter CLK and the address pointer PNT. The process then moves to step 40.

In step 40, each of the key-code registers $KCREQ_0$ to $KCREQ_3$ is cleared. The process then moves to step 42.

In step 42, each of the key-code buffer registers $KCBUF_0$ to $KCBUF_N$ is cleared. The process then moves to step 43.

In step 43, the process decides whether the value of the auto-play mode flag AP is equal to "1" or not. If the decision is "Y", the process moves to step 44, otherwise it moves to step 64.

In step 44, the process decides whether a key-on event is present in the guide mode indication switch GDSW or not. If the decision is "Y", the process moves to step 46, otherwise it moves to step 64.

In step 46, the guide mode flag GUIDE is inverted. The process then moves to step 48.

In step 48, the process decides whether the value of guide mode flag GUIDE is equal to "1" or not. That is, whether a guide mode is indicated or not. If the decision is "Y", the process moves to step 50 to start the operation of the guide mode, otherwise it moves to step 58 to stop the operation of the guide mode.

In step 50, the process of a key-off is executed so that all of the channels of tone generator $TG_K$ stop generating musical tones. The process then moves to step 52.

In step 52, each of the key-code registers $KCREQ_0$ to $KCREQ_3$ is cleared. The process then moves to step 54.

In step 54, the process decides whether the value of relative event time interval counter CNT is equal to "1" or "2". That is, whether a key-depression timing is prior to the thirty-second note or the sixteenth note. For example, in the case where both of the guide mode indication switch GDSW and auto-play mode indication switch APSW are simultaneously turned on, the above decision is "Y" because the value of the auto-play mode flag AP is equal to "1" in step 34, and afterwards, the value of the relative event time interval counter CNT is equal to "1". On the other hand, in the case where the value of the relative event time interval counter CNT is "1" or "2" in an On-state of the guide mode indication switch GDSW when the automatic performance is in progress, since the value of auto-play mode flag AP is equal to "1", the decision becomes "Y" in step 54. The process then moves to step 56.

Figure 7:
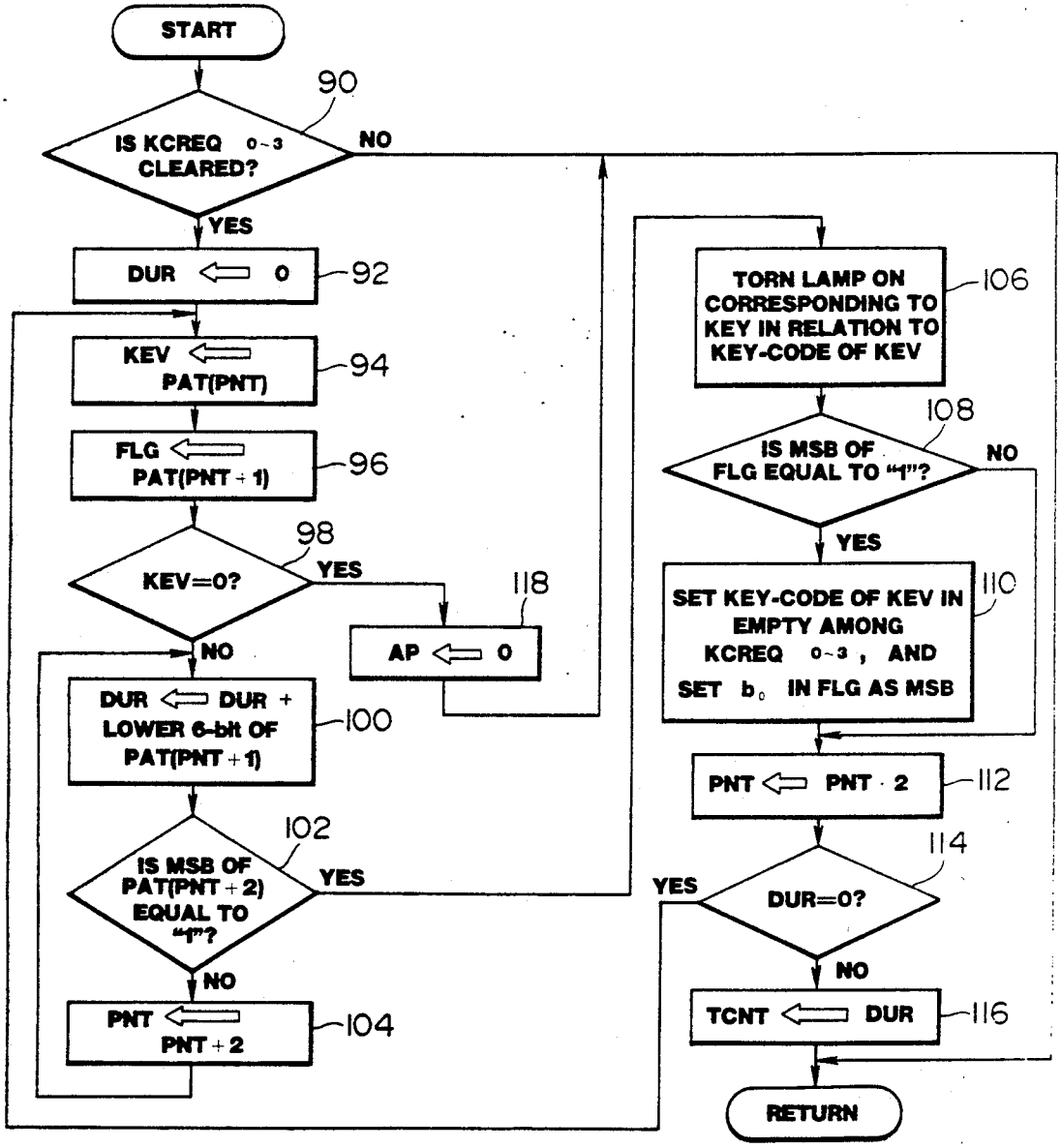
FIG. 7 is a flow chart showing a subroutine for turning lamps on and off.

In step 56, a subroutine for turning lamps on is executed as shown in FIG. 7, which is described later. As a result, a key-depression indication lamp is turned at the thirty-second note or sixteenth note prior to the time when the key should be depressed, the key-depression indication lamp corresponding to a first musical note which should be played by a first key after turning the guide mode indication switch GDSW on.

In step 58, the process of the key-off is executed so that all of the channels of the tone generator $TG_K$ stop generating musical tones. The process then moves to step 60.

In step 60, each of the key-code registers $KCREQ_0$ to $KCREQ_3$ is cleared. The process then moves to step 62.

In step 62, all of the key-depression indication lamps are turned off.

In step 64, the process decides whether a key-on event is present for any keys of the keyboard or not. If the decision is "Y", the process moves to step 66, otherwise it moves to step 78.

In step 66, a key-code is stored in an empty one of the key-code registers $KCREQ_0$ to $KCREQ_3$, in which the key-code corresponds to the key-on event which is present in the key. The process then moves to step 68.

In step 68, the process decides whether the value of the guide mode flag GUIDE is equal to "1" or not, and whether the value of the auto-play mode flag AP is equal to "0" or not. That is, whether the system is in the guide mode or normal mode. If the decision is "Y", the process moves to step 70, otherwise it moves to step 78.

In step 70, the process of the key-on event corresponding to tone generator $TG_K$ is executed. That is, a key-code corresponding to the key-on event is assigned to an empty channel of tone generator $TG_K$ to generate a musical tone signal corresponding to the key-code. The process then moves to step 72.

In step 72, the process decides whether the value of guide mode flag GUIDE is equal to "1" or not. If the decision is "Y", the process moves to step 74, otherwise it moves to step 78.

In step 74, the process decides whether the value of relative event time interval counter CNT is equal to "0" or not. That is, whether the time interval is in stand-by or not. If the decision is "Y", the process moves to step 76, otherwise it moves to step 78.

Figure 8:
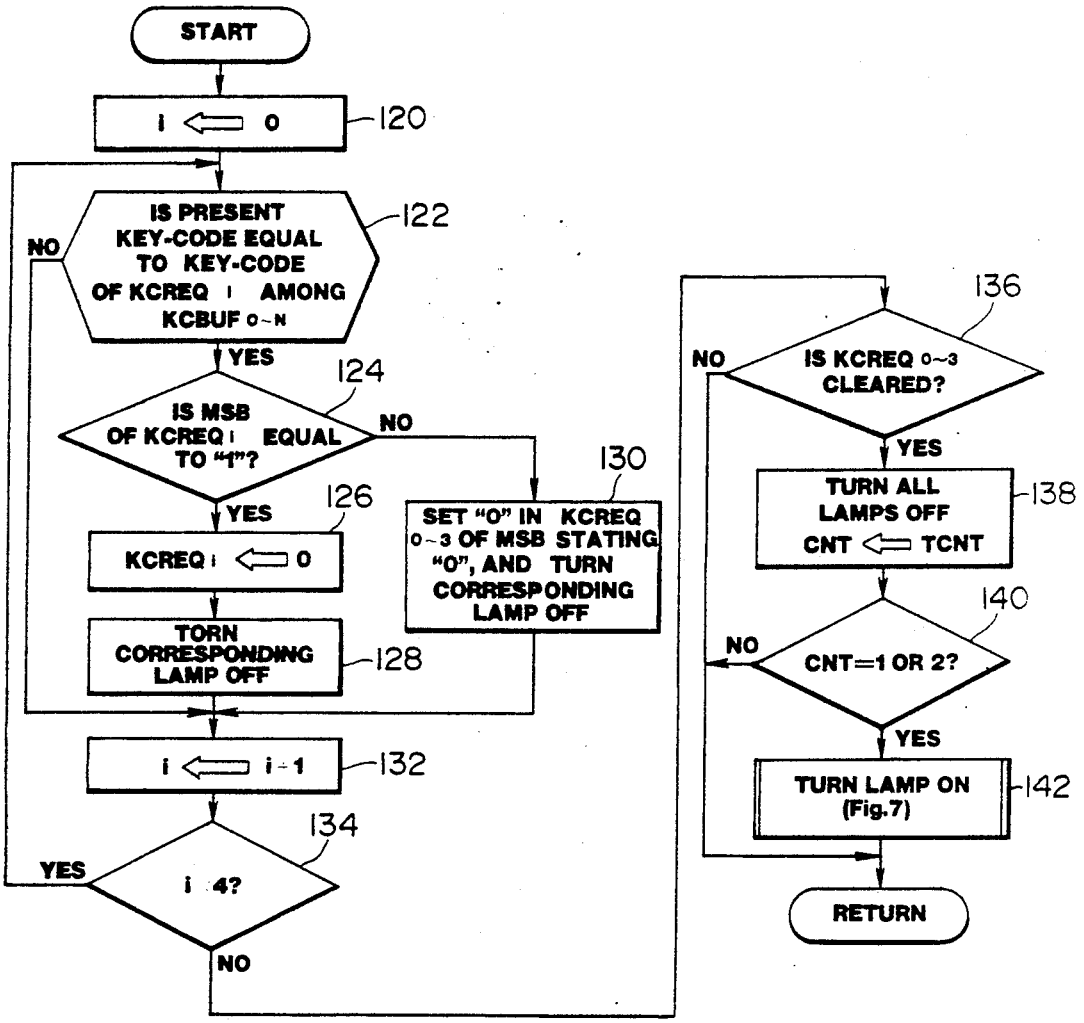
FIG. 8 is a flow chart showing a subroutine for examining keys.

In step 76, a subroutine for examining a depressed key is executed as shown in FIG. 8. Details of the flow are described later. In the case where the musical notes are not the exceptional examination object and hence do not require an examination, the subroutine executes a key-depression indication no matter whether the key is correctly depressed or not. In the case where the musical notes are the selectively or compulsory examination object which requires the examination, the subroutine executes the key-depression indication if the key is correctly depressed. The process then moves to step 78 if the process of the subroutine is terminated.

In step 78, the process decides whether a key-off event is present in any key of the keyboard or not. If the decision is "Y", the process moves to step 80, otherwise it moves to step 86.

In step 80, the key-code which is stored in key-code buffer registers $KCBUF_0$ to $KCBUF_3$ and which is related to the key-off event is cleared. The process then moves to step 82.

In step 82, the process decides whether the value of guide mode flag GUIDE is equal to "1" or not, and whether the value of auto-play mode flag AP is equal to "0" or not, the same as in step 68. If the decision is "Y", the process moves to step 84, otherwise it moves to step 86.

In step 84, the key-off process corresponding to tone generator $TG_K$ is executed. That is, the channel assignment of the key-code related to the key-off event is canceled to stop generating musical tone signals corresponding to the key-code. The process then moves to step 86.

In step 86, other processes are executed, such as a rhythm selection process based on the operation of the rhythm selection switches, a tone color selection process based on the operation of the tone color selection switches, a tone volume setting process based on the operation of the tone volume setting switches, a tempo setting process based on the operation of the tempo setting switches, and the like.

Afterwards, the process returns to step 32 to repeat the processes described above.

FIG. 7 shows the subroutine for turning lamps on.

Figure 9:
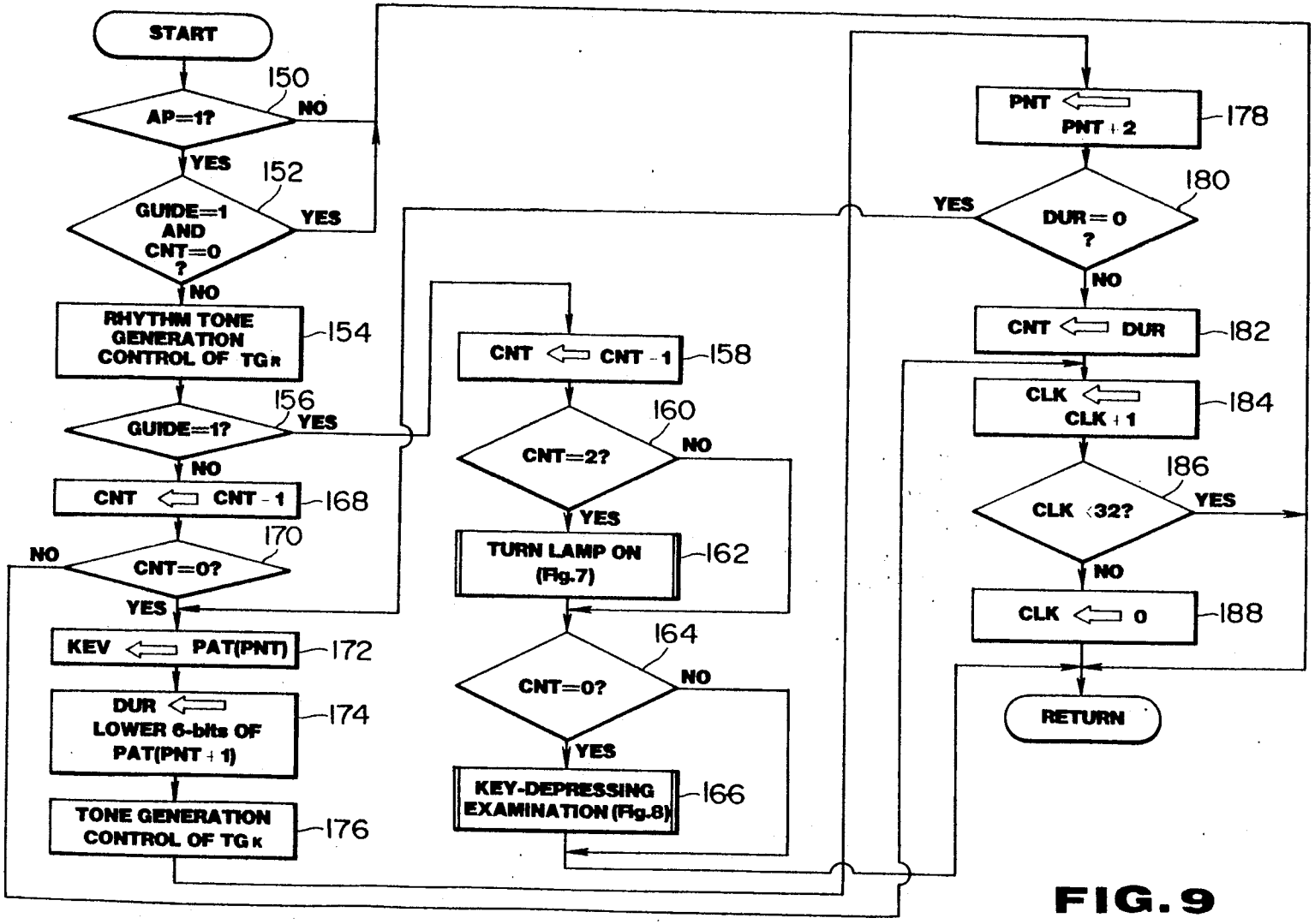
FIG. 9 is a flow chart showing a clock interrupting routine.

In step 90, the process decides whether each of the key-code registers $KCREQ_0$ to $KCREQ_3$ is cleared or not. If the decision is "N", in the process executed by the subroutine shown in FIG. 8, a key corresponding to a musical note which is a selectively or compulsory examination object is not correctly depressed. Thus, the process does not move to a key-depression indication of the next musical note, and returns to the next step of the previous routine, such as shown in FIG. 6, FIG. 8, or FIG. 9. If the decision is "Y" in step 90, the process moves to step 92.

In step 92, "0" is set in the relative event time interval buffer register DUR. The process then moves to step 94.

In step 94, 1-byte of data PAT (PNT) is read from storage area PAT indicated by address pointer PNT for storing in key-code read register KEV. The process then moves to step 96. The data PAT (PNT is of data which represents a key-on or key-off, and a key-code.

In step 96, the next 1-byte of data PAT (PNT+1) is read from storage area PAT for storing in examination object register FLG. The process then moves to step 98. The data PAT (PNT+1) is data which represents examination flags $b_0$ and $b_1$, and data representing by the relative event time interval.

In step 98, the process decides whether the value of key-code read register KEV is equal to "0" or not, that is, end data END or not. If the decision is "N", the process moves to step 100, otherwise it moves to step 118.

In step 100, the value of relative event time interval buffer register DUR is added to the 6-bits (relative event time interval) of data PAT (PNT+1), then the added value is set in the relative event time interval buffer register DUR. The process then moves to step 102. In such a case, the relative event time interval buffer register DUR becomes "0" in step 92. Afterwards when the process moves to step 100 for the first time, the value of the relative event time interval buffer register DUR is equal to the lower 6-bits of data PAT (PNT+1).

In step 102, the process decides whether the MSB of the data PAT (PNT+2) is equal to "1" or not. The data PAT (PNT+2) is the next second address to the data PAT (PNT). If the decision is "Y", that is, next key-event should be a key-on event, the process moves to step 106. Otherwise, the next key-event should be a key-off event, and the process moves to step 104.

In step 104, the value of the address pointer is incremented by "2". The process then returns to step 100 to repeat the above steps.

The processes of steps 100 to 104 are used for transferring a process to the next key-on event by ignoring a key-off event. For example, when data of key-on event $KON_2$ is set in key-code read register KEV in step 94 as shown in FIG. 3, the value of the relative event time interval buffer register DUR becomes $\Delta t_2+\Delta t_3$ by returning the process from step 100 through steps 102 and 104, and again to step 100. When the process moves from step 100 to step 102, the decision is "Y" because the next key-event is key-on event $KON_3$.

In step 106, a key-depression indication lamp is turned on, which corresponds to a key-code stored in key-code read register KEV. The process then moves to step 108.

In step 108, the process decides whether the MSB of examination object register FLG is equal to "1" or not, that is, an examination is required or not. If the decision is "Y", the process moves to step 110, otherwise it moves to step 112.

In step 110, the key-code stored in key-code read register KEV and flag $b_0$ of examination object register FLG is set in an empty register among the key-code registers $KCREQ_0$ to $KCREQ_3$ As a result, a combination flag $b_0$ with a key-code is set in one of the key-code registers $KCREQ_0$ to $KCREQ_3$ as shown in FIG. 4.

In step 112, the value of address pointer PNT is incremented by "2". The process then moves to step 114. Thus, address pointer PNT indicates the first byte of the key-on event data which should be read next.

In step 114, the process decides whether the value of the relative event time interval buffer register DUR is equal to "0" or not. If the decision is "N", a musical note is being individually depressed. The process therefore moves to step 116. If the decision is "Y", a plurality of musical notes which are being simultaneously depressed. The process therefore moves to step 94 to repeat the steps for executing the processes described above.

Accordingly, in the case where repetition of the processes is executed, the relative event time interval becomes "0" except for the last arrangement of the key-on event data which is arranged in correspondence with the plurality of musical notes. Each of the key-depression indication lamps corresponding to the plurality of musical notes is, in turn, turned on when the process in step 106 is executed in a plurality of times. When the process in step 108 is executed in plural times, the process decides whether each of the musical notes requires an examination or not. In step 108, if the decision is that the plurality of musical notes require the examination, the plurality of combinations the of flag $b_0$ with the key-codes corresponding to the plurality of musical notes are set in the plurality of registers among key-code registers $KCREQ_0$ to $KCREQ_3$. In addition, the relative event time interval arranged in the last key-on event data is finally set in the relative event time interval buffer register DUR in step 100.

In step 116, the value of the relative event time interval buffer register DUR is set in the relative event time interval register TCNT. The process then returns to the next step of the subroutines shown in FIG. 6, FIG. 8 and FIG. 9.

In step 118, the auto-play mode flag AP is set to "0", then the process returns to the next step of the subroutine. The process of step 118 is executed when the decision is "Y" in step 98, that is, when reading performance data is terminated.

FIG. 8 shows the subroutine for examining depressed keys.

In step 120, control variable i is set to "0". The process then moves to step 122.

In step 122, the process decides whether a key-code which is equal to the key-code of key-code register $KCREQ_i$ among the key-code buffer registers $KCBUF_0$ to $KCBUF_N$ is present or not, that is, a tone pitch is equal or not. If the decision is "Y", a key is correctly depressed. The process then moves to step 124. Otherwise if the decision is the exceptional examination object or the key is not correctly depressed, it moves to step 132.

In step 124, the process decides whether the MSB of key-code register $KCREQ_i$ is equal to "1" or not, that is, whether the musical note is the compulsory examination object or not. If the decision is "Y", the process moves to step 126, otherwise it moves to step 130 because a key corresponding to a musical note is the selectively examination object in this case.

In step 126, "0" is set in key-code register $KCREQ_i$. The process then moves to step 128.

In step 128, a key-depression indication lamp corresponding to a key which is correctly depressed is turned off.

In step 130, each of the key-code registers $KCREQ_0$ to $KCREQ_3$ having flag $b_1=0$, is set by "0", and each of the key-depression indication lamps corresponding to a plurality of key-codes having flag $b_1=0$, is turned off. The process then moves to step 132. As a result, in the case where keys corresponding to two musical notes among three which should be simultaneously depressed, are the selectively examination object, each of the two key-depression indication lamps is turned off when a key corresponding to one musical note of two is correctly depressed.

In step 132, control variable i is incremented by "1". The process then moves to step 134.

In step 134, the process decides whether the value of control variable i is less than "4" or not. If the decision is "Y", the process returns to step 122 to continue repetition of the processes as far as the value of control variable i is equal to "4". If the decision is "N", the process moves to step 136 because control variable i is equal to "4". As a result, in the case where keys corresponding to two musical notes among three which should be simultaneously depressed, are the compulsory examination object, two key-depression indication lamps are, in turn (substantially the same time), turned off when the two keys corresponding to two musical notes are correctly depressed.

In step 136, the process decides whether each of the key-code registers $KCREQ_0$ to $KCREQ_3$ is cleared or not. If the decision is "Y", the process moves to step 138, otherwise it returns to the next step of the routines shown in FIG. 6 or FIG. 9, because a key corresponding to one musical note among them is not being correctly depressed, even though these keys are the examination objects. When the decision is "Y" in this step, either the musical notes corresponding to the key-codes stored in key-code buffer registers $KCBUF_0$ to $KCBUF_N$ are not the examination object, or, the musical notes are the examination object and the corresponding keys are correctly depressed.

In step 138, all of key-depression indication lamps are turned off to make it possible to proceed to the next key-depression indication. In addition, the contents of the relative event time interval register TCNT are set in the relative event time interval counter CNT. The process then moves to step 140.

In step 140, the process decides whether "1" or "2" is contained in the relative event time interval counter CNT or not. That is, whether this time is that of the thirty-second note or the sixteenth note prior to the time when the key should be depressed or not. If the decision is "Y", the process moves to step 142 to execute the processes of the subroutine shown in FIG. 7, that is, turning the lamps on and off is executed, otherwise it returns to the next step of the routines shown in FIG. 6 and FIG. 9, because the time until next key is depressed is longer than that of the sixteenth note. Therefore, in next musical note following the sixteenth or thirty-second note, if a previous musical note (sixteenth or thirty-second note) is not an examination object, a key-depression indication lamp corresponding to the next musical note is turned on no matter whether a key is correctly depressed or not when the previous key corresponding to the musical note is depressed. If the previous musical note is the examination object, the key-depression indication lamp corresponding to the next musical note is turned on when the key corresponding to the previous musical not is correctly depressed.

FIG. 9 shows a clock interruption routine. The routine starts at every pulse of the tempo-clock signal TCL.

In step 150, the process decides whether the value of auto-play mode flag AP is equal to "1" or not, that is, the auto-play mode or the guide mode. If the decision is "N", the process returns to the main routine. If the decision is "Y", the process moves to step 152.

In step 152, the process decides whether the value of guide mode flag GUIDE is equal to "1" or not, and the value of the relative event time interval counter CNT is equal to "0" or not. That is, the process decides whether the time is standing-by following the time when a key should be depressed in the guide mode, or not. If the decision is "Y", the process returns to the main routine shown in FIG. 6. That is, it makes that the automatic rhythm performance and the key-depression indication does not advance so that the key is not correctly depressed, even though a time when a key should be depressed has already passed. In the main routine, when the content of the relative event time interval register TCNT is set in the relative event time interval counter CNT (step 138 of FIG. 8) by determining the key which is correctly depressed in step 76, and in step 152 of FIG. 9, the decision becomes "N". Accordingly, in the case where the musical note is the examination object, the automatic rhythm performance and the key-depression indication can be advanced when a key is correctly depressed.

If the decision is "N" in step 152, the process moves to step 154. In this case, the type of the mode is the auto-play mode because the guide mode flag GUIDE is equal to "0", or the operation time is prior to the time when a key should be depressed in the guide mode according to the value of the relative event time interval counter CNT which is not equal to "0".

In step 154, a rhythm tone generation control for tone generator $TG_R$ is executed. That is, rhythm pattern data is selected which corresponds to the type of rhythm selected by the rhythm selection switch. In the rhythm pattern data, the rhythm tone source on and off data for use in 6-channels is read and is addressed by the value of tempo-clock counter CLK. The rhythm source on and rhythm source off data is supplied to the 6-channels. As a result, a percussion instrument tone signal is generated from a channel corresponding to a bit indicated by "1" ("on" instruction) in the rhythm tone source on and off data. The process then moves to step 156.

In step 156, the process decides whether the value of guide mode flag GUIDE is equal to "1" or not, that is, the guide mode or not. If the decision is "Y", the process moves to step 158, otherwise it moves to step 168.

In step 158, the relative event time interval counter CNT is documented by "1". The process then moves to step 160.

In step 160, the process decides whether the value of the relative event time interval counter CNT is equal to "2" or not, that is, whether the operation time is the sixteenth note prior to the time when a key is depressed or not. If the decision is "Y", the process moves to step 162 for executing the subroutine shown in FIG. 7, otherwise it moves to step 164. Accordingly, a lamp is normally turned on for the sixteenth note prior to the time when a key is depressed except that the lamp is not turned on, in step 54 of FIG. 6 and in step 140 of FIG. 8 when the value of the relative event time interval counter CNT is equal to "1".

In step 164, the process decides whether the value of the relative event time interval counter CNT is equal to "0" or not, that is, whether the operation timing corresponds to a time when a key should be depressed or not. If the decision is "Y", the process moves to step 166 for executing the examination of the depressed key in the subroutine shown in FIG. 8. The process then returns to the main routine shown in FIG. 6. If the decision is "N", the process also returns to the main routine.

When the process enters step 166 because the relative event time interval counter CNT is equal to "0", in step 136 shown in FIG. 8, if the decision is "Y", that is, if the decision is the exceptional examination object or the key is correctly depressed, the key-depression indication is advanced. If the decision is "N", that is, if the key is not correctly depressed, the process returns to the main routine shown in FIG. 6. In step 76 of the main routine, the process moves to the subroutine shown in FIG. 8. If the decision in step 136 is "Y", the key-depression indication is advanced, but if the decision is "N", when the process moves to step 152 shown in FIG. 9, the decision in step 136 is "Y" and the process again returns to the main routine. Therefore, the key-depression indication stops proceeding as far as the key which is correctly depressed. When the key is correctly depressed, in step 76 of the main routine, the decision in step 136 shown in FIG. 8 becomes "Y", and the key-depression indication is again proceeded.

In step 168, the value of relative event time interval counter CNT is decremented by "1". The process then moves to step 170.

In step 170, the process decides whether the value of relative event time interval counter CNT is equal to "0"

or not, that is, whether the relative event time interval is a termination time or not. If the decision is "Y", the process moves to step 172, otherwise it moves to step 184.

In step 172, data PAT (PNT) of 1-byte is read from the address in the storage area PAT indicated by the address pointer PNT for setting key-code read register KEV. At this time, data PAT (PNT) is data which represents key-on or key-off data, and a key-code.

In step 174, data PAT (PNT+1) of 1-byte which is the next data of data PAT (PNT), is read from the next address in storage area PAT, and lower 6-bits (relative event time interval) thereof is set in relative event time interval buffer register DUR. The process then moves to step 176.

In step 176, the tone generation control of tone generator $TG_K$ is executed, that is the process decides whether the MSB of the key-code read register KEV indicates a key-on or key-off event. If the decision is a key-on, the key-code of the key-code read register KEV is assigned to an empty channel to generate a musical tone signal corresponding to the key-code. If the decision is the key-off, the assignment of the key-code channel is canceled to stop generating a musical tone signal corresponding to the key-code. The process then moves to step 178.

In step 178, the address pointer PNT is incremented by "2" to indicate the next address storing the next key-event of the first byte. The process then moves to step 180.

In step 180, the process decides whether the content of relative event time interval buffer register DUR is equal to "0" or not. If the decision is "N", the process moves to step 182. If the decision is "Y", the key-event data which should generate or kill a tone in the same time, is present plural number thereof, therefore, the process returns to step 172 to repeat the processes described above. As a result, it causes 3-chords to be generated or killed at substantially the same time. In addition, the relative event time interval is set in the relative event time interval buffer register DUR, in which the relative event time interval is of the lastly arranged data among the plurality of key-event data.

In step 182, the content of the relative event time interval buffer register DUR are set in the relative event time interval counter CNT. The process then moves to step 184.

In step 184, the value of the tempo-clock counter CLK is incremented by "1". The process then moves to step 186.

In step 186, the process decides whether the value of the tempo-clock counter CLK is less than "32" or not, that is, a small bar or not. If the decision is "Y", the process returns to the main routine. If the decision is "N", the small bar is terminated because the tempo-clock counter CLK is equal to "32". "0" is set in the tempo-clock CLK in step 188, then the process returns to the routine shown in FIG. 6.

Accordingly, the automatic performance of a melody, a chord, and the like, can be performed in correspondence with the performance data stored in the performance data memory 24 according to steps 168 to 182. In addition, a rhythm in one small bar can be repeatedly and automatically performed in accordance with selected rhythm pattern data in the performance data memory 24 according to steps 154 and 184 to 188.

The present invention is not limited by the embodiment described above, and variations to the embodiment are as follows;

(1) In the examination to determine if the key is correctly depressed or not, the element of the examination can also be a tone pitch with a time when a key is released.

(2) Each of the plural parts can be controlled by switching the guide mode on and off. For example. when both a melody part and an accompaniment part are provided. While one part can be performed automatically, and the other part is set in the guide mode to practice a performance, or both parts can be set in the guide mode to practice the performance.

(3) In the embodiment, a starting time for switching the key-depression indication lamps is the thirty-second note or the sixteenth note prior to the time when the key should be depressed. The starting time can also be set earlier than or later than these notes.

(4) The data format is not limited in the embodiment, for example, the relative event time interval can be set in a small bar.

The preferred embodiment described herein is illustrative and not restrictive; the scope of the invention is indicated by the appended claims and all variations which fall with the claims are intended to be embraced therein.

What is claimed is:

1. An automatic key-depression indication apparatus comprising:

(a) a keyboard having a plurality of keys;

(b) a plurality of key-depression indication elements corresponding to each of the keys;

(c) key-depression detection means for detecting a depressed key and for generating key-depression information corresponding to the depressed key;

(d) key-depression indication control means for controlling the indication elements to cause them to indicate keys which should be depressed based on previously stored pieces of musical note information respectively corresponding to the keys;

(e) selection means for selecting at least one piece of information from among the pieces of musical note information, the selected musical note information being less than the total of the musical note information;

(f) examination means for examining whether correspondence exists between the selected musical note information and the key-depression information; and (g) advance control means connected to the key-depression indication control means and the examination means, for causing the key-depression indication control means to continue progression of an indication operation when the examination means determines that a correspondence exists between the selected musical note information and the key-depression information, and for causing the key-depression indication control means to stop the indication operation when the examination means determines that there is no correspondence between the selected musical note information and the key-depression information.

2. An automatic key-depression indication apparatus according to claim 1, wherein said selection means previously assigns an examination object identification to the at least one piece of the musical note information, and said examination means identifies the selected musical note information according to the examination object identification.

3. An automatic key-depression indication apparatus comprising:

(a) a keyboard having a plurality of keys;

(b) a plurality of key-depression indication elements corresponding to each of the keys;

(c) key-depression detection means for detecting a depressed key and for generating key-depression information corresponding to the depressed key;

(d) storage means for storing musical note information representing each of serial musical notes, the serial musical notes including plural musical notes corresponding to plural keys which should be simultaneously depressed;

(e) key-depression indication control means for indicating keys which should be depressed, by actuating the key-depression indication elements respectively corresponding to the musical note information read from the storage means;

(f) examination means for examining whether selected musical note information corresponding to at least one of the plural musical notes, corresponds to the key-depression information or not, wherein the selected musical note information is less than the total number of the plural musical notes; and (g) advance control means connected to the key-depression indication control means and the examination means, for causing the key-depression indication control means to continue progression of an indication operation when the examination means determines that there is a correspondence, and for causing the key-depression indication control means to stop the indication operation when the examination means determines that there is no correspondence.

4. An automatic key-depression indication apparatus according to claim 3, in which an examination object identification is previously assigned to the plural musical notes, wherein said examination means identifies the selected musical note information according to the examination object identification.

5. An automatic key-depression indication apparatus according to claim 3 in which said key-depression indication control means further actuates the key-depression indication elements at every reading of the musical note information from the storage means in accordance with the progression of reading musical notes, and actuates plural key-depression indication elements simultaneously be reading continuously a plurality of portions of the musical note information from the storage means for the plural keys which should be simultaneously depressed.

6. An automatic key-depression indication apparatus according to claim 5 in which the examination means examines whether or not a tone pitch of the musical note information read out from the storage means corresponds to the tone pitch of the key-depression information output from the key-depression detection means.

7. An automatic key-depression indication apparatus according to claim 3 in which the examination means controls the key-depression indication control means so that when the examination means detects a correspondence, or when the musical note information read from the storage means is not the selected musical note information, the examination means causes the key-depression indication control means to continue progression of an indication operation, whereas when the examination means determines no correspondence, the advance control means causes the key-depression indication control means to stop the indication operation until the examination means determines a correspondence.

* * * * *